US007068293B2

(12) United States Patent
Wang

(10) Patent No.: US 7,068,293 B2
(45) Date of Patent: Jun. 27, 2006

(54) METHOD OF AUTOMATIC MONITOR DISPLAY ADJUSTMENTS

(75) Inventor: Jui-Ming Wang, Taipei (TW)

(73) Assignee: AmTRAN Technology, Taipei (TW)

( * ) Notice: Subject to any disclaimer, the term of this patent is extended or adjusted under 35 U.S.C. 154(b) by 353 days.

(21) Appl. No.: 10/632,812

(22) Filed: Aug. 4, 2003

(65) Prior Publication Data

US 2004/0183823 A1 Sep. 23, 2004

(30) Foreign Application Priority Data

Mar. 21, 2003 (TW) ..... 92106308 A

(51) Int. Cl.
*G09G 5/02* (2006.01)

(52) U.S. Cl. ..... 345/698; 345/204; 345/699

(58) Field of Classification Search ..... 345/3.4, 345/204, 211, 214, 698–699, 87–104; 348/184, 348/558

See application file for complete search history.

(56) References Cited

U.S. PATENT DOCUMENTS 6,121,962 A * 9/2000 Hwang ..... 345/211
6,366,263 B1 * 4/2002 Takasu et al. ..... 345/13
6,392,642 B1 * 5/2002 Wu ..... 345/213
6,597,373 B1 * 7/2003 Singla et al. ..... 345/698
6,674,491 B1 * 1/2004 Tsou ..... 348/819

* cited by examiner

*Primary Examiner*—Ricardo Osorio
*Assistant Examiner*—Mansour M. Said
(74) *Attorney, Agent, or Firm*—Harness, Dickey & Pierce, P.L.C.

(57) ABSTRACT

A method of automatic monitor display adjustments is disclosed. After the monitor is connected to the power and receives a display signal from a computer host, NTAA (No Touch Auto Adjustment) is initiated to automatically adjust the display range and other display settings of the monitor.

11 Claims, 4 Drawing Sheets

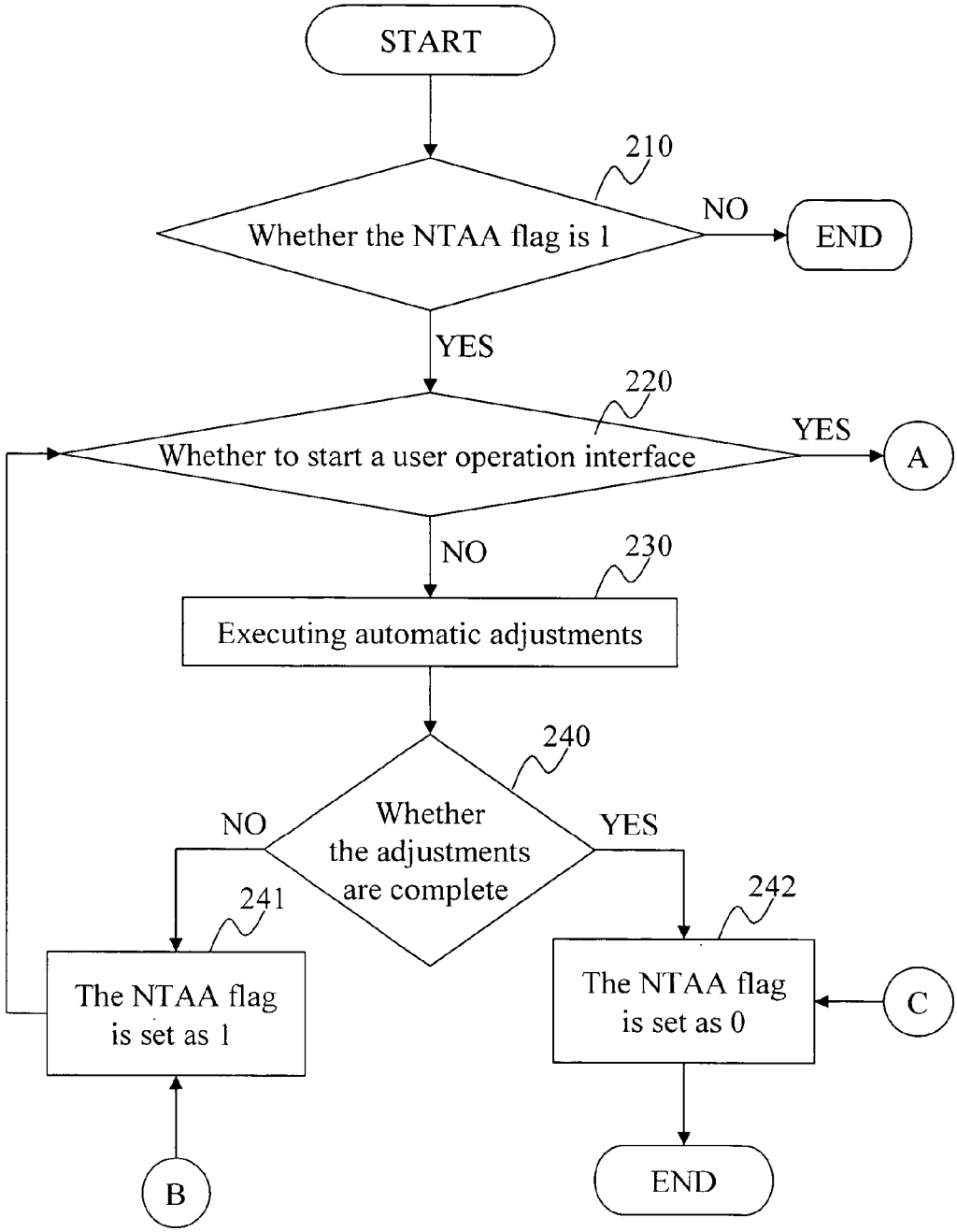
FIG.2-A

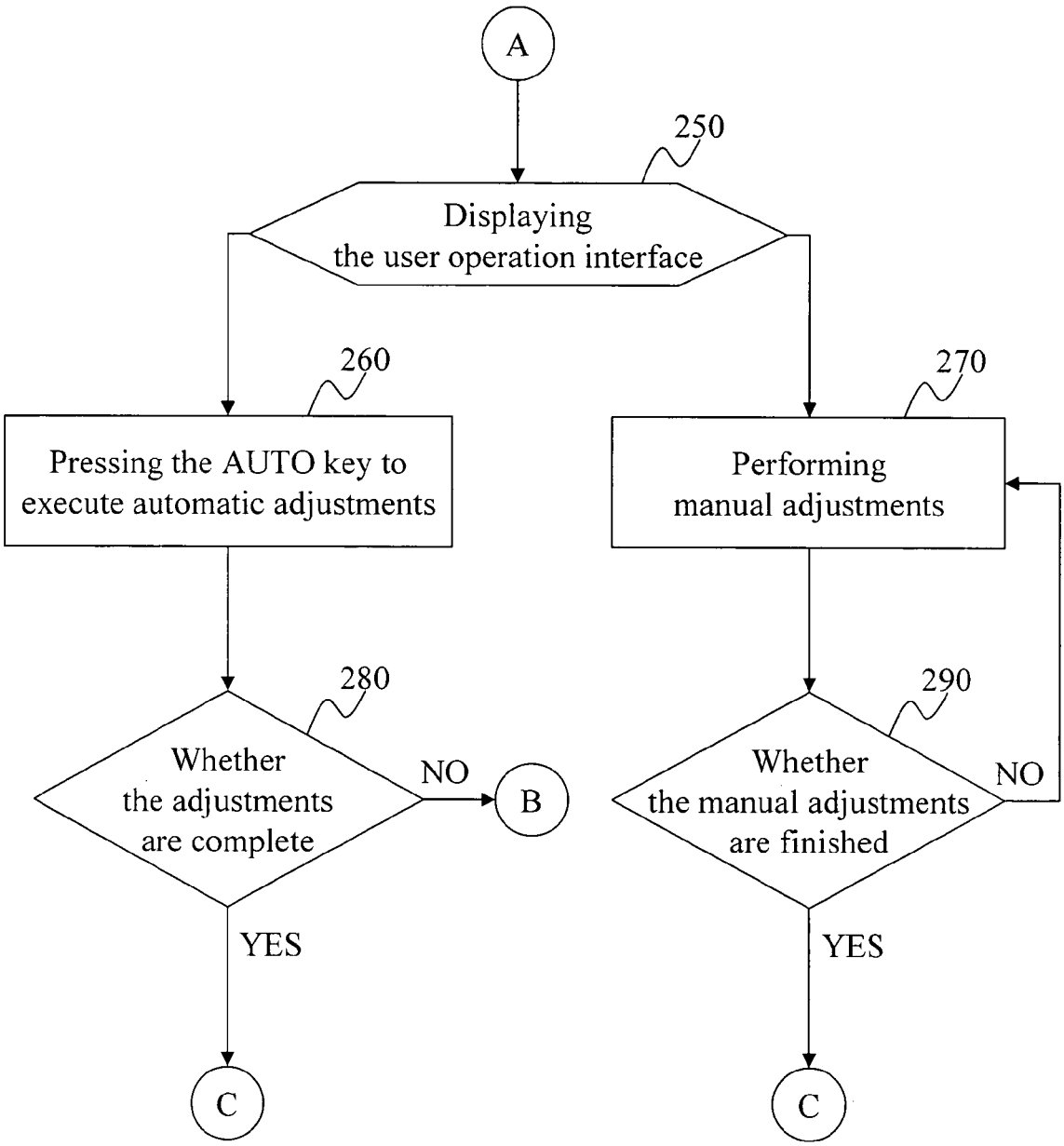
FIG.2-B

METHOD OF AUTOMATIC MONITOR DISPLAY ADJUSTMENTS

BACKGROUND OF THE INVENTION

1. Field of Invention

The invention relates to a method of automatically adjusting monitor display to tune the monitor display screen.

2. Related Art

Currently, the monitors on the market, including the traditional cathode ray tubes (CRT's), the popular thin-film field transistor (TFT) liquid crystal displays (LCD's) or even the future plasma displays (PDP's), usually use the default settings when the monitor first receives display signals. Therefore, it is often seen that the frame is shifted to one side, larger or smaller than the screen. In order for the display frame to fit the screen, monitor manufacturers often provide some tuning buttons for the users to make adjustments at his or her will.

In spite of this, some users are afraid of using the manufacturer provided tuning buttons simply because they do not know how to use them. Therefore, the tuning mechanisms provided by the manufacturers are considered as not human enough. To help these users, certain manufacturers start to design a new tuning button, the so-called AUTO button. Using this button, the user can adjust the screen to satisfactory settings without much trouble.

Even so, this pushing button action still requires human manipulation. Therefore, if the adjustment procedure can be performed or controlled by a program or device so that the screen is automatically tuned to the best display range and conditions, the users will be less afraid of using the monitors.

SUMMARY OF THE INVENTION

In view of the foregoing problems, the invention provides a method of automatic monitor display adjustments. After the monitor is connected to the power and receives a display signal from a computer host, NTAA (No Touch Auto Adjustment) is initiated to automatically adjust the display range and other display settings of the monitor.

It is thus an objective of the invention to provide an automatic monitor adjustment method, through which the user can obtain a desired screen display effect without tuning it on his or her own.

To achieve the above objective, the disclosed method includes the steps of: receiving a screen display signal; determining whether the screen display signal does not satisfy the monitor display range; executing automatic adjustments for the monitor display to automatically tune the display region to the best range.

From the above brief description of the disclosed system and method, one sees that the problems existing in the prior can be solved. It is also expected that the monitor screen can be automatically tuned to satisfy the user without manual adjustments.

BRIEF DESCRIPTION OF THE DRAWINGS

The invention will become more fully understood from the detailed description given hereinbelow illustration only, and thus are not limitative of the present invention, and wherein:

FIGS. 2-A and 2-B are detailed flowcharts of the disclosed method; and

DETAILED DESCRIPTION OF THE INVENTION

The specification discloses a method of automatic monitor display adjustments. After the monitor is connected to a power source and receives a display signal from a computer host, the method automatically tunes the display range of the screen without user's manual adjustments.

Figure 1:
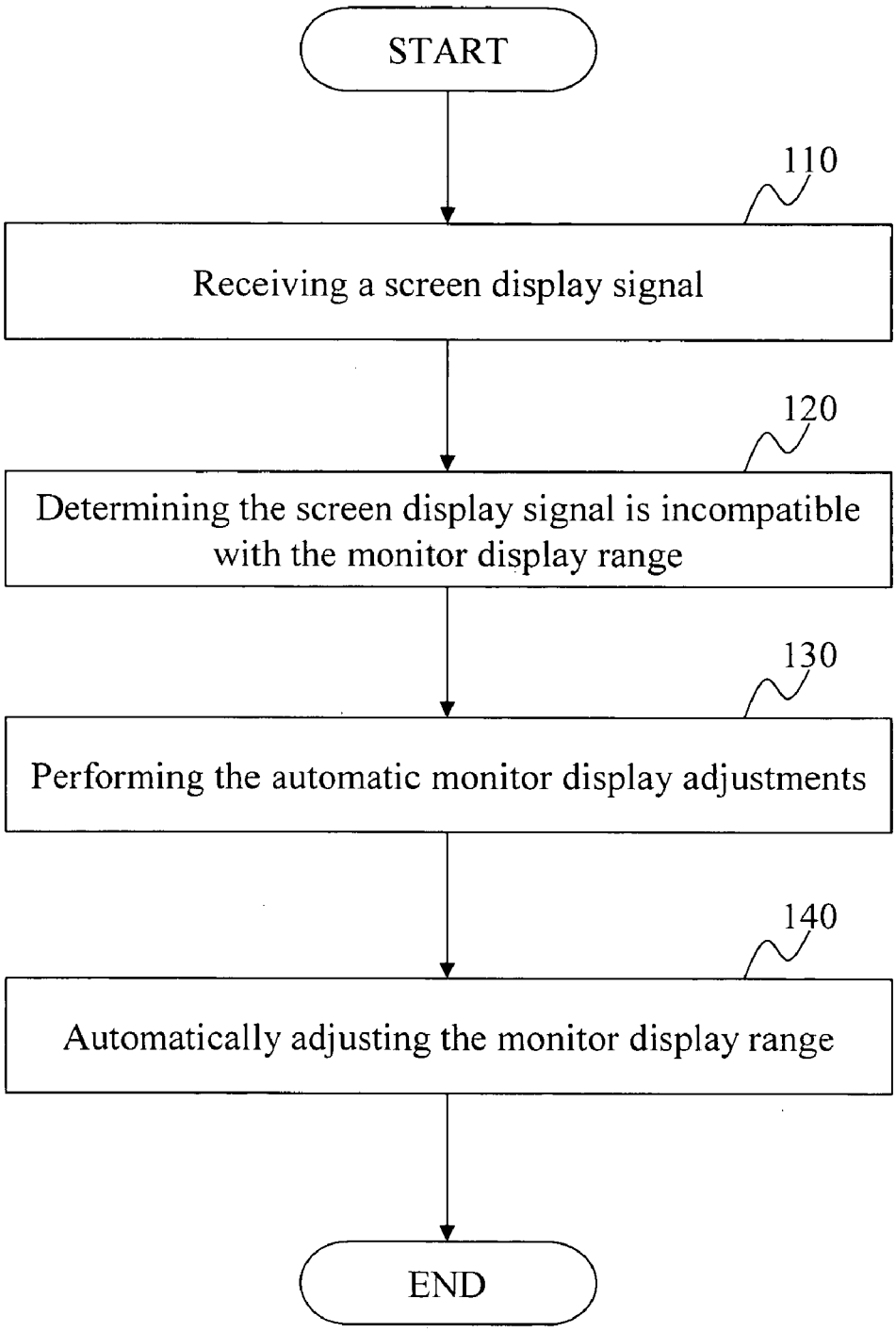
FIG. 1 is the main flowchart of the disclosed method of automatic monitor display adjustments.

With reference to FIG. 1, the monitor first receives a screen display signal (step 110). If the screen display signal is determined to be incompatible with the monitor display range (step 120), the automatic monitor display adjustments are performed (step 130). The monitor display range is also automatically adjusted (step 140), until the screen display signal fit with the monitor display range.

The method is an NTAA for monitors. Once the monitor is connected to a power source and the display card of a computer host, it can receive screen display signals transmitted from the computer host and display the images. However, in the beginning of screen displays, the NTAA first determines whether the display signal fits the monitor display range. If the display signal does not fit the monitor display range, the NTAA executes the automatic screen adjustments to tune the screen display to the optimal viewable range. It achieves the goal that the monitor screen has the best display range without user's manual adjustments.

After the above explanation with reference to FIG. 1, we further use FIGS. 2-A and 2-B to show an embodiment of the invention, describing the automatic adjustment procedure in more detail.

As shown in FIG. 2-A, after the monitor is connected to the power source and starts to receive screen display signals from a computer, the NTAA first determines whether the flag of the NTAA is 1 (step 210). If the result is a "no," then it means that the monitor display settings have been adjusted and the NTAA automatically shuts down. The monitor then receives and displays the image signals from the computer. If the result is a "yes," then the NTAA further determines whether to start a user operation interface (step 220). If the user does not touch any operation key in the monitor panel, the system starts to execute automatic adjustments (step 230). At this moment, the NTAA adjusts the display conditions of the monitor according to the setting records stored in the memory. After the monitor display conditions are modified, the NTAA also determines whether the adjustments are complete (step 240). If the determination result is a "no," then the flag of the NTAA is set as 1 (step 241); the system returns to step 210 to repeat the previously mentioned procedure. If the determination result is a "yes," then the flag of the NTAA is set as 0 (step 242). The NTAA automatically shuts down; and the monitor starts to receive and display screen displays signals transmitted from the computer.

In FIG. 2-A, if the user touches any operation key on the monitor panel during step 220 (determining whether to start a user operation interface), the user operation interface is displayed (step 250), as shown in FIG. 2-B and the system waits for the operation signal from the user. When the user presses the AUTO key to execute automatic adjustments (step 260), the NTAA adjusts the screen display conditions according to the setting records stored in the memory. After the monitor display conditions are modified, the NTAA also determines whether the adjustments are complete (step 280). If the determination result is a "yes," then the flag of the NTAA is set as 0 (step 242). The NTAA automatically shuts down; and the monitor starts to receive and display screen displays signals transmitted from the computer. If the determination result is a "no," then the flag of the NTAA is set as 1 (step 242), as shown in FIG. 2-A; the system returns to step 210 to repeat the previously mentioned procedure.

In FIG. 2-B, when the user uses the operational keys on the monitor panel of step 250 to perform manual adjustments (step 270) to tune the monitor screen display, the NTAA adjusts the display screen accordingly and records the user's adjustment settings. After the user performs the tuning for a while, the NTAA determines whether the manual adjustments are finished (step 290). If the determination result is a "no," then the user keeps performing manual adjustments (step 270). If the determination result is a "yes," then the flag of the NTAA is set as 0 (step 242), as shown in FIG. 2-A. The NTAA automatically shuts down and the monitor starts to receive and display the image signals transmitted from the computer.

In describing the above preferred embodiment, the procedure further contains the procedure of changing the monitor display settings to the default ones. We use FIG. 3 to explain the procedure for recalling the flag of the NTAA.

Figure 3:
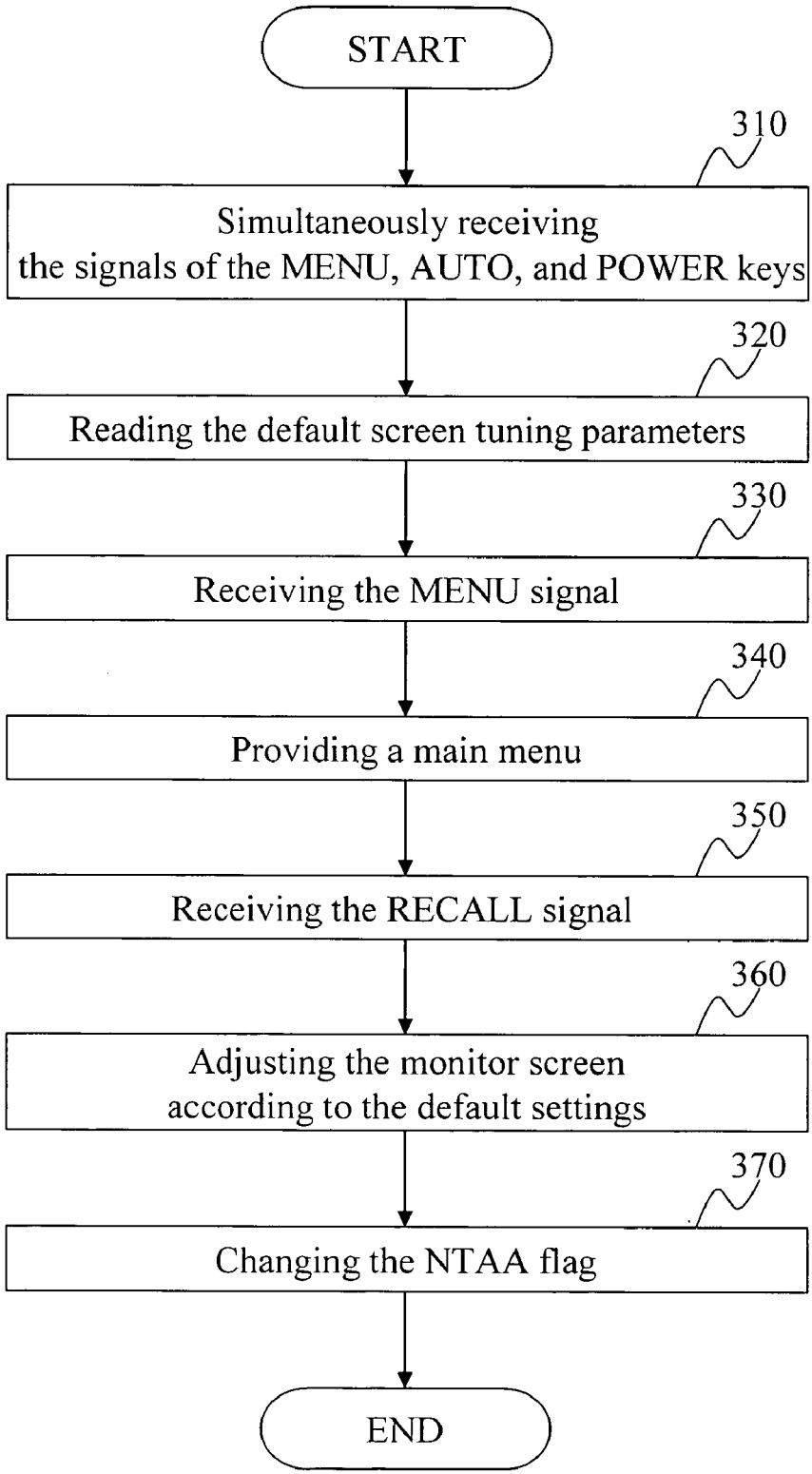
FIG. 3 is a flowchart of recalling the flag of the NTAA according to the invention.

As shown in FIG. 3, before executing the monitor setting recall, one has to simultaneously press the MENU, AUTO, and POWER keys. After the monitor simultaneously receives the signals of the MENU, AUTO, and POWER keys (step 310), the monitor starts to read the default screen tuning parameters (step 320) to prepare for the display setting recall. At this moment, the user has to press the MENU key for the monitor to receive the MENU signal (step 330). A main menu is then provided for the user to use (step 340). Through the guidance of the main menu, the user is led to execute the RECALL command. After the monitor receives the RECALL signal (step 350), the monitor screen is adjusted according to the default settings (step 360). After finishing the RECALL settings, the NTAA flag is changed (step 370), completing the whole RECALL procedure.

The adjustments of the screen display settings include the following items to be tuned: the CONTRAST value, the BRIGHTNESS value, the COLOR settings, the screen signal settings (such as LCD ADJUST), the display language setting, the H-OSD POSITION setting, the V-OSD POSITION setting, the SMOOTHING setting, and the INVISIBLE value. Through the default settings of the above items, the screen display can be automatically adjusted to the preset display mode.

Certain variations would be apparent to those skilled in the art, which variations are considered within the spirit and scope of the claimed invention.

What is claimed is:

1. A method of automatic monitor display adjustments for automatically adjusting the monitor display when a first screen display signal is received after the monitor power is turned on, the method comprising:

receiving the screen display signal;

determining that the screen display signal is not compatible with the monitor display range;

executing automatic monitor display adjustments; and automatically adjusting the monitor display range;

wherein the executing automatic monitor display adjustments, and the automatically adjusting the monitor display range includes recalling a no-touch-auto-adjustment (NTAA) flag which includes:

simultaneously receiving a menu signal, an auto signal, and a power signal;

reading a default monitor display settings;

receiving the menu signal and providing a main menu;

receiving a recall signal;

adjusting the screen display according to the default monitor display settings; and changing the no-touch-auto-adjustment (NTAA) flag.

2. The method of claim 1 further providing a user operation interface for the user to adjust monitor display settings.

3. The method of claim 1, wherein adjusting the screen display according to the default monitor display settings includes adjusting a contrast value.

4. The method of claim 1, wherein adjusting the screen display according to the default monitor display settings includes adjusting a brightness value.

5. The method of claim 1, wherein adjusting the screen display according to the default monitor display settings includes a color to preset adjustment.

6. The method of claim 1, wherein adjusting the screen display according to the default monitor display settings includes adjusting monitor signals.

7. The method of claim 1, wherein adjusting the screen display according to the default monitor display settings includes language reset.

8. The method of claim 1, wherein adjusting the screen display according to the default monitor display settings includes adjusting an H-OSD (Horizontal On Screen Display) Position.

9. The method of claim 1, wherein adjusting the screen display according to the default monitor display settings includes adjusting a V-OSD (Vertical On Screen Display) Position.

10. The method of claim 1, wherein adjusting the screen display according to the default monitor display settings includes a smoothing adjustment.

11. The method of claim 1, wherein adjusting the screen display according to the default monitor display settings includes an invisible adjustment.

* * * * *